United States Patent [19]

Hadany

[11] 4,034,554

[45] July 12, 1977

[54] CLOCK WITH MOVING COLORED DISPLAY

[75] Inventor: Israel Hadany, Jerusalem, Israel

[73] Assignee: International Product Development, Ltd., Los Angeles, Calif.

[21] Appl. No.: 625,599

[22] Filed: Oct. 24, 1975

[30] Foreign Application Priority Data

Apr. 18, 1975 Spain ..... 211626[U]

[51] Int. Cl.[2] ..... G04B 19/02; G04B 45/00; G04B 19/30

[52] U.S. Cl. ..... 58/125 B; 58/2; 58/50 R

[58] Field of Search ..... 58/1 R, 2, 50 R, 125–127

[56] References Cited

U.S. PATENT DOCUMENTS

| | | | |
|---|---|---|---|
| 268,641 | 12/1882 | Dittmar et al. | 58/1 R |
| 463,010 | 11/1891 | Terlinden et al. | 58/1 R |
| 2,625,003 | 1/1953 | Burden | 58/2 |
| 2,824,418 | 2/1958 | Hilbert | 58/144 |
| 3,522,701 | 8/1970 | Perry | 58/1 R |

FOREIGN PATENT DOCUMENTS

| | | | |
|---|---|---|---|
| 723,527 | 7/1942 | Germany | 58/144 |

*Primary Examiner*—E. S. Jackmon
*Attorney, Agent, or Firm*—Poms, Smith, Lande & Glenny

[57] ABSTRACT

A set of one or more closed receptacles, each having an internal partition dividing the interior into two compartments, each compartment being partially filled with a translucent flowable material such as a colored liquid. Preferably the receptacles are cylindrical in shape with the partitions extending diametrically, and the flowable material in a receptacle compartment is of a different color from that of the other compartment of the receptacle and, desirably, different from the color of flowable materials in other compartments of a particular set. Means are provided for rotating the receptacles about axes transverse to their partitions and, when a set of two receptacles is used as a clock, one receptacle is rotated at two revolutions per day and the other at one revolution per hour, as by a conventional synchronous clock motor. Thus, the partitions of such a set serve as hour and minute hands respectively, and each partition may be provided with a small marker or indicium near one of its ends to serve as the pointer for the hand. A third smaller receptacle may be driven at one revolution per minute, its partition thus serving as a second hand. The two or three receptacles of a set may be coaxially arranged one behind another, or with their circular faces all visible to the observer, as in a common plane. In the coaxial arrangement, the changing color relationships seen by the observer provide an understanding of the theory of subtractive mixture of colors. A light source may be provided behind the set of receptacles, and each receptacle is desirably mounted to facilitate setting of the time which it indicates.

7 Claims, 7 Drawing Figures

FIG. 5
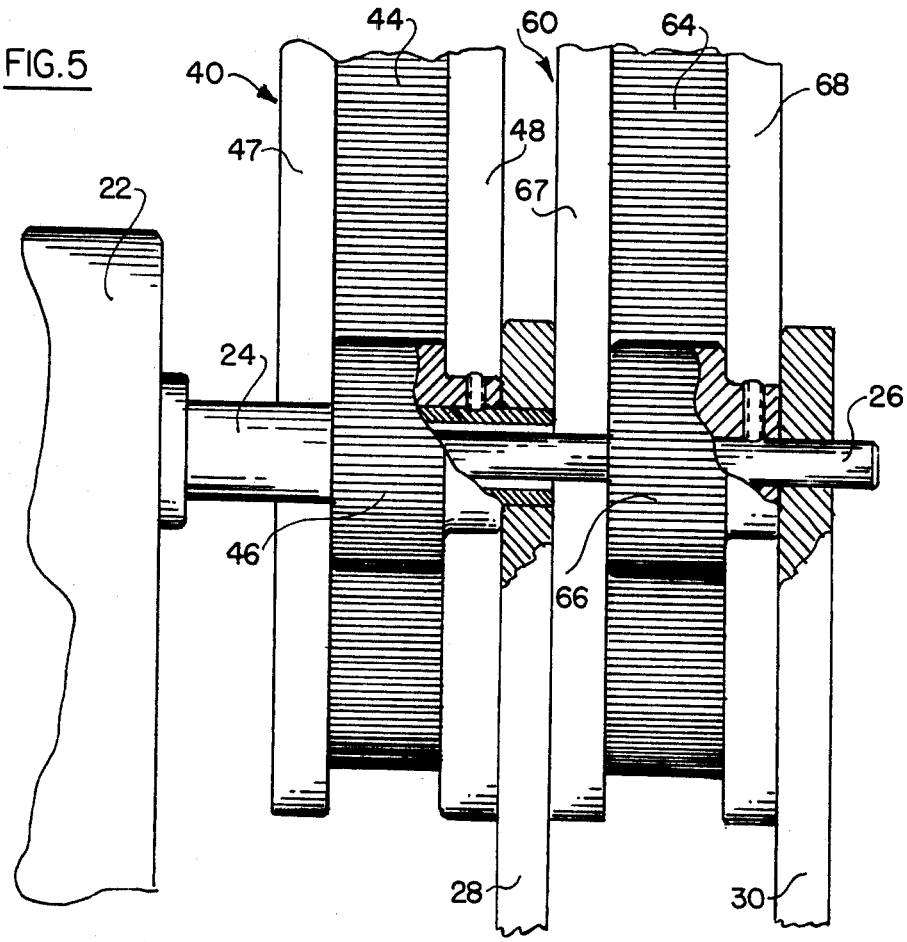
FIG. 6
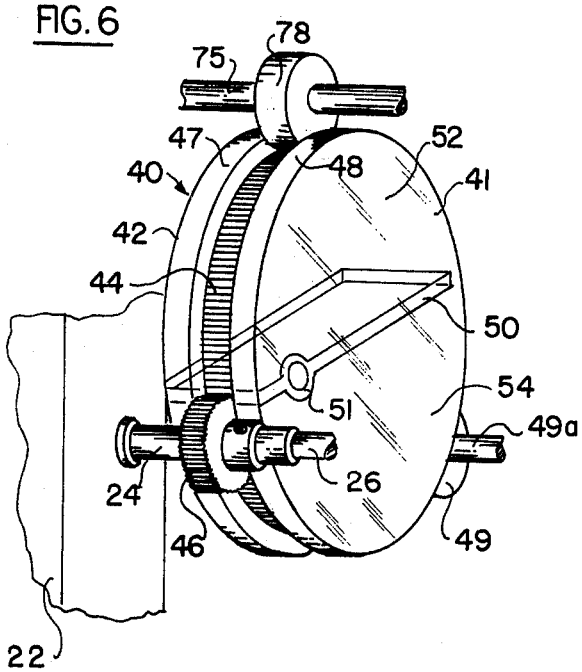
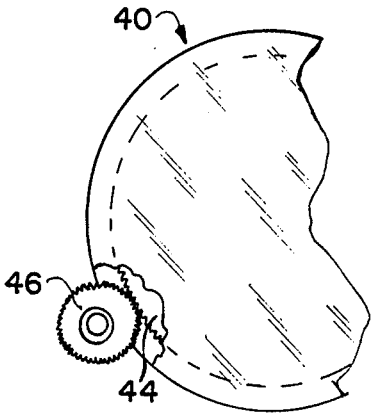
FIG. 7

CLOCK WITH MOVING COLORED DISPLAY

BACKGROUND AND SUMMARY OF THE INVENTION

The present invention relates generally to timekeeping display devices, and more particularly to such a device characterized by the provision of one or more transparent receptacles, preferably cylindrical, each provided with an internal partition dividing the interior of the receptacle into a plurality of compartments each being partially filled with a flowable translucent colored material. When the receptacle is rotated by suitable means about an axis transverse to the length of the partition, the changing angles between the horizontal surfaces of the flowable materials and the partitions provide a vivid and colorful display of the time. When two such cyclindrical receptacles are provided one behind the other, and are rotated at suitable relative speeds about a common axis transverse to the receptacle partitions, the partitions serve as hour and minute hands respectively, and the apparent color seen by the observer from the front serves to emphasize the principles of mixtures of colors. The resulting display may be heightened by providing a light source behind the rear receptacle, and a third similar receptacle may be provided whose partition serves as a second hand. The flowable materials are preferably translucent colored liquids.

Accordingly, it is a principal object of the invention to provide a clock characterized by a novel changing color display. Other objects are to disclose such a device having at least one internally partitioned receptacle containing in each of its compartments a quantity of colored translucent flowable material and rotatable about an axis transverse to the partition; to provide in such a device a second similar receptacle similarly rotated at a speed of twelve times that of the first receptacle; to provide such a multi-receptacle device wherein the receptacles are arranged in tandem and are rotated about a common axis; to provide in such a device a light source rearwardly of the receptacles to heighten the changing color display of the device; and for other purposes as will be understood from a reading of the following description of a preferred embodiment of the invention taken in connection with the accompanying drawings.

BRIEF DESCRIPTION OF THE DRAWINGS

FIG. 5 is a vertical sectional view on an enlarged scale showing a typical drive mechanism which may be used to rotate the receptacles of the device.

FIG. 6 is a perspective view of the rear receptacle and its driving and support means.

FIG. 7 is a detailed view of a typical driving engagement of the receptacle.

DETAILED DESCRIPTION

Figure 2:
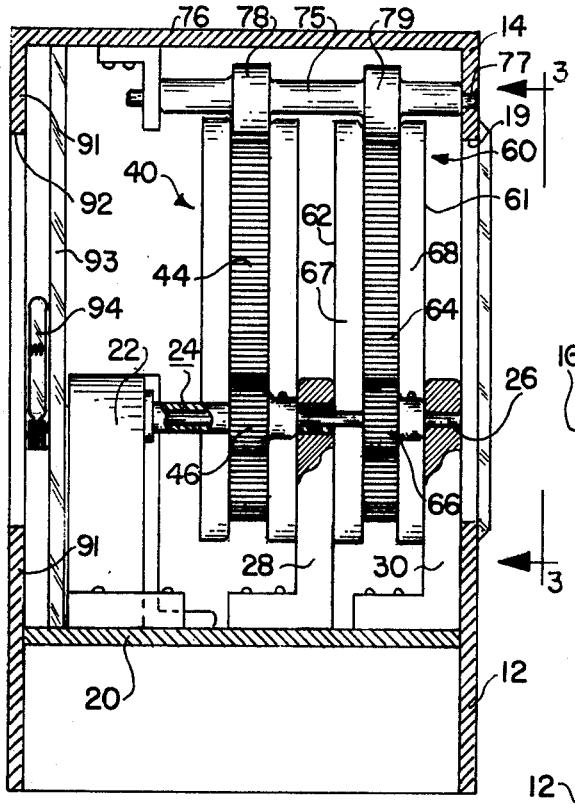
FIG. 2 is a vertical sectional view taken on line 2—2 of FIG. 1.
Figure 1:
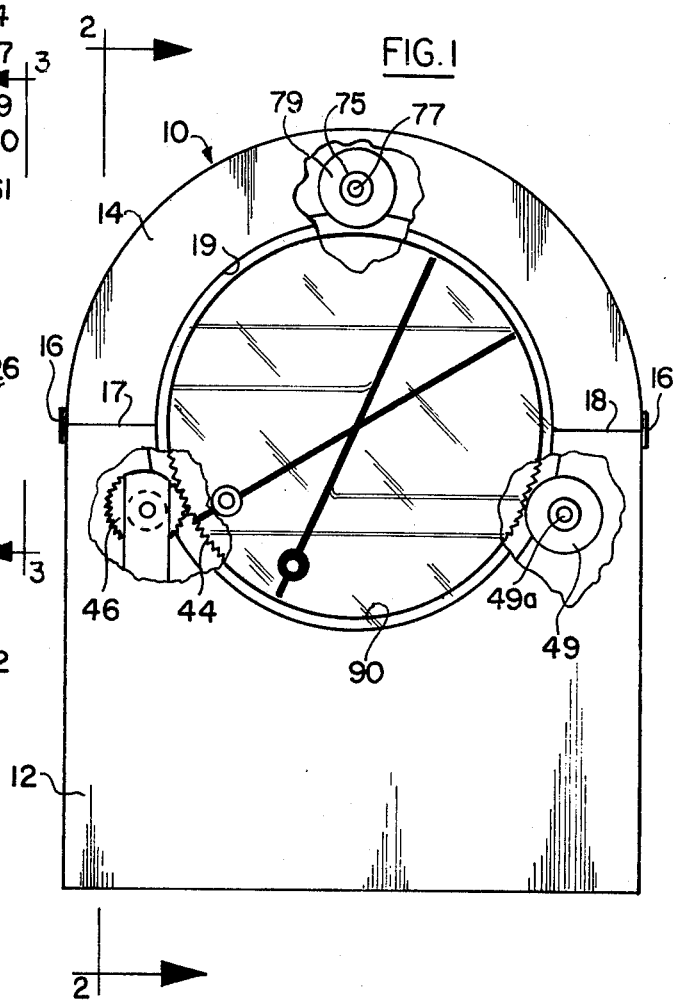
FIG. 1 is a front view of a clock embodying my invention, with parts broken away for clarity of illustration.

With reference first to FIG. 1, a housing indicated generally at 10 includes a base portion 12 and a cover portion 14 removably attached together by suitable means 16 along mating walls 17 and 18. The front face of the housing has a generally circular opening 19 formed therein. Within housing 10, as best seen in FIG. 2, is a horizontal support wall 20 on which is mounted a synchronous drive motor 22 of the type conventionally used in electric clocks and having two output shafts (see FIG. 5) including an outer tubular shaft 24 and a coaxial inner rod shaft 26. Vertical support brackets 28 and 30 extend upwardly from horizontal wall 20, and the outer ends of shafts 24 and 26 respectively are journaled in brackets 28 and 30.

With reference to FIG. 6, a receptacle indicated generally at 40 is made of transparent material such as a suitable plastic, and is generally cylindrical in shape including transparent front and rear walls 41 and 42 respectively. The periphery includes a serrated portion 44 constituting a driven gear meshing with a driving pinion 46 mounted on shaft 24. The serrated portion 44 is desirably recessed radially between flanking cylindrical support flanges 47 and 48. An idler support roller 49 is carried on a shaft 49a mounted on housing base 12, and serves to rollingly support serrated portion 44. It will be noted that pinion 46 and roller 49, as best seen in FIG. 1, are below the horizontal center of receptacle 40, to permit the receptacle to be lifted upwardly in order to set the correct hour, minute or second which it indicates, as will be later understood.

Figure 4:
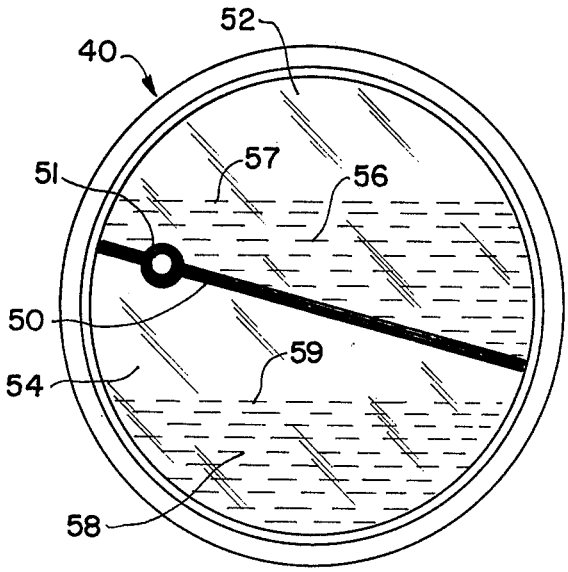
FIG. 4 is an isolated front view of one of the rotatable receptacles.

Receptacle 40 is provided with an internal flat partition 50 extending longitudinally along a diameter of the receptacle and dividing the interior of the receptacle into two compartments 52 and 54, as best seen in FIG. 4. An indicium 51 such as a small circle may be provided on the receptacle in line with one end portion of the partition in order to indicate the pointer of the hand of the clock. Each compartment is partially filled with a quantity of flowable translucent material, here shown as a liquid 56 and 58, whose respective upper surfaces 57 and 59 of course remain horizontal while the receptacle is rotated about a horizontal axis transverse to the partition 50.

A second receptacle, similar in shape and construction to receptacle 40, is indicated generally at 60 and is best seen in FIG. 2. Thus receptacle 60 has transparent front and rear walls 61 and 62 and a peripheral serrated driven gear 64 recessed radially between flanking cylindrical support flanges 67 and 68. Gear 64 is driven by driver pinion 66, which is mounted on rod shaft 26.

Shafts 24 and 26 may rotate at speeds having a 12:1 ratio to one another, for a conventional clock application. Thus driver pinion 46 may rotate at a speed sufficient to cause receptacle 40 to rotate one revolution every twelve hours, and driver pinion 66 drives receptacle 60 at one revolution per hour, so that the indicia-bearing partitions of receptacles 46 and 66 serve as hour and minute hands respectively. As will be evident, a third driving shaft and pinion driving a third similar receptacle at one revolution per minute could be used to provide a second hand.

Means may be provided to stabilize the rotatable receptacles and thus to prevent accidental disengagement of a receptacle from its meshing relationship with its driver pinion, as during movement of the clock from one location to another, and during shipment. Thus, as seen in the upper portion of FIG. 2, a rod 75 is mounted on cover 14 by means of bracket 76 and journal 77, and carries thereon a series of members 78 and 79, each of which is loosely received between the spaced flanges of the respective receptacles 40 and 60, preferably out of contact with the respective gears 46 and 66 to avoid wear on the latter. In FIG. 7, there is shown a detailed view, with a portion of the flange broken away, illustrating more clearly the meshing engagement of driver pinion 46 with the serrated portion 44 of receptacle 40.

A light source is desirably provided in the rear portion of the housing so that the user observes the translucent flowable material within the receptacle compartments as illuminated from behind the receptacles. Thus the rear walls 90 and 91 of base 12 and cover 14 are desirably formed to provide a central opening 92 in alignment with the receptacles, so that ambient light may enter from the rear and pass through a light diffuser 93. To supplement ambient light, an artificial light source such as a small electric lamp 94 may be mounted on the housing behind diffuser 93.

Figure 3:
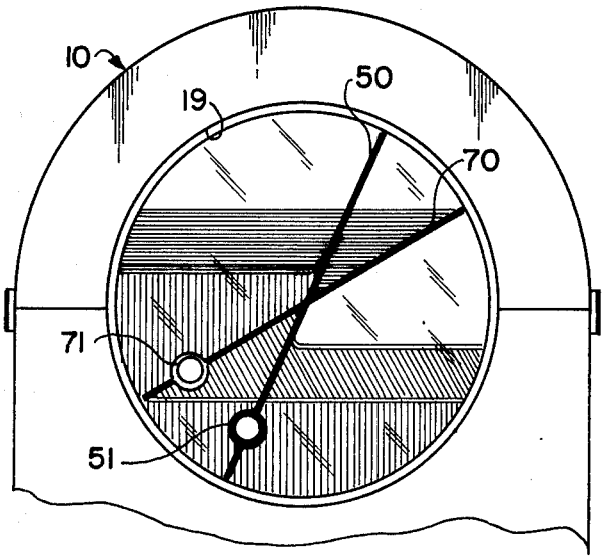
FIG. 3 is a detailed view taken on line 3—3 of FIG. 2.

In operation, with reference primarily to FIGS. 1 and 3, the angular relationships between partition 50 and the surfaces of colored flowable material in the compartments of receptacle 40 vividly show the position of the partition and thus the hour or minute, as the case may be; and the same is true with respect to partition 70 and its indicium 71 of the second receptacle 60. When the user observes the set of receptacles in tandem, through the opening 90 in the front wall of the housing, he sees varying color relationships and combinations, leading to a lasting understanding of the laws of subtractive mixtures of colors.

Alternatively, the set of receptacles can be arranged so that the front faces of the receptacles lie in a common vertical plane, with the receptacles side-by-side, or with one mounted above the other. As will be understood, such an arrangement provides a chromatically vivid showing of the time, but does not provide the added feature of displaying color mixtures.

Typically the translucent flowable material within each receptacle compartment is colored liquid, the liquids in the various compartments differing in color among themselves. Alternatively, the flowable material may consist of a large number of very small colored translucent microspheres of glass or a suitable synthetic plastic composition.

The flowable material, in whatever form it may take, is of substantially smaller volume than its receptacle compartment, in order that its horizontal surface is clearly visible to bring out the changing color relationships during operation. No specific proportion is critical for effective operation, but is preferred that the volume of flowable material be approximately one-half the volume of its receptacle compartment.

I claim:

1. A clock comprising:

a housing provided with a front face having a generally circular opening formed therein, a hollow closed receptacle rotatably mounted within the housing, having a transparent front wall and provided with an internal generally flat longitudinally extending partition carrying an indicium near one of its ends and dividing the interior of the receptacle into totally enclosed compartments, a quantity of flowable material partially filling each compartment, and means for rotating the receptacle at constant speed about an axis transverse to said partition and concentric with said opening.

2. The invention as defined in claim 1 wherein said receptacle is cylindrical, and said partition extends diametrically of the receptacle.

3. The invention as defined in claim 2 wherein said materials are of different colors.

4. The invention as defined in claim 1 including a second receptacle identical to the first named receptacle, and means for rotating the second receptacle about an axis transverse to its partition at a predetermined multiple of the speed of rotation of the first named receptacle, the plane of rotation of the second receptacle being parallel to that of the first receptacle.

5. The invention as defined in claim 4 wherein the flowable materials in the first named receptacle are different in color from the flowable materials in said second receptacle.

6. The invention as defined in claim 5 wherein the first and second receptacles rotate about a common axis.

7. The invention as defined in claim 5 wherein said flowable materials are liquids.

* * * * *